US008317113B2

(12) United States Patent
Uegaki et al.

(10) Patent No.: US 8,317,113 B2
(45) Date of Patent: Nov. 27, 2012

(54) ELECTROSTATIC ATOMIZATION DEVICE

(75) Inventors: Hidesato Uegaki, Hikone (JP); Osamu Imahori, Kadoma (JP); Kenji Obata, Hikone (JP); Atsushi Isaka, Hikone (JP)

(73) Assignee: Panasonic Corporation, Osaka (JP)

( * ) Notice: Subject to any disclaimer, the term of this patent is extended or adjusted under 35 U.S.C. 154(b) by 371 days.

(21) Appl. No.: 12/730,914

(22) Filed: Mar. 24, 2010

(65) Prior Publication Data

US 2010/0243765 A1 Sep. 30, 2010

(30) Foreign Application Priority Data

Mar. 26, 2009 (JP) ..... 2009-076282
Mar. 26, 2009 (JP) ..... 2009-076283
Mar. 26, 2009 (JP) ..... 2009-076284

(51) Int. Cl.
*B05B 5/025* (2006.01)
*B05B 5/16* (2006.01)
*B05B 5/00* (2006.01)

(52) U.S. Cl. ..... 239/690; 239/706

(58) Field of Classification Search ..... 239/3, 67, 239/690, 704–707; 361/227, 228
See application file for complete search history.

(56) References Cited

U.S. PATENT DOCUMENTS 5,992,511 A 11/1999 Kodaira et al.
2008/0130189 A1* 6/2008 Kobayashi et al. ..... 361/228
2009/0001200 A1* 1/2009 Imahori et al. ..... 239/700
2009/0179092 A1* 7/2009 Akisada et al. ..... 239/690
2009/0289132 A1* 11/2009 Watanabe et al. ..... 239/690

FOREIGN PATENT DOCUMENTS

EP 2025411 A1 2/2009
JP 2006-239632 9/2006
JP 2006296962 11/2006
JP 2007144293 6/2007
JP 2007275799 10/2007
WO 2008007704 A1 1/2008

* cited by examiner

*Primary Examiner* — Darren W Gorman
(74) *Attorney, Agent, or Firm* — James R. Gourley; Carstens & Cahoon, LLP

(57) ABSTRACT

An electrostatic atomization device that electrostatically atomizes condensed water and emits atomized water. The electrostatic atomization device includes a discharge electrode. A water supplier unit includes a cooling unit coupled to the discharge electrode to cool the discharge electrode and a heat radiation unit coupled to the cooling unit to emit heat when the cooling unit performs cooling. The cooling unit cools air and produces condensed water on the discharge electrode. A controller includes electronic components mounted on a circuit board. A casing accommodates the discharge electrode, the water supplier unit, and the controller. First electronic components each of which temperature is increased by a predetermined value or greater are arranged in a heat radiation unit side region of the circuit board.

13 Claims, 6 Drawing Sheets

ELECTROSTATIC ATOMIZATION DEVICE

BACKGROUND OF THE INVENTION

The present invention relates to an electrostatic atomization device that electrostatically atomizes and emits liquid.

An electrostatic atomization device known in the prior art applies high voltage to a discharge electrode to which water is adhered to generate an electrical discharge. This causes Rayleigh fission in the adhered water on the discharge electrode and generates mist of a microscopic size (refer to, for example, Japanese Laid-Open Patent Publication No. 2006-239632).

In the electrostatic atomization device of Japanese Laid-Open Patent Publication No. 2006-239632, the moisture in the air is supplied to the discharge electrode by cooling the discharge electrode, which is accommodated in a casing, with a Peltier element (Peltier module). The supplied water is electrostatically atomized by applying high voltage to the discharge electrode and thereby generating mist of a microscopic size.

SUMMARY OF THE INVENTION

In the above-described electrostatic atomization device, various types of electric circuits, such as a high voltage generation circuit (high voltage application unit) for applying high voltage to the discharge electrode, are accommodated in the casing. Electronic components having a relatively large heat loss (large heat generation), such as a transistor and a coil, are used in the electric circuit. Due to such electronic components, the temperature in the casing tends to be high.

In the above-described electrostatic atomization device, the Peltier element has a heat absorption metal plate that cools the discharge electrode. Thus, when cooling the discharge electrode, heat is released from a metal plate (heat radiation metal plate) located opposite to the heat absorption side metal plate of the Peltier element.

As described above, members that easily generate heat are arranged at a plurality of locations in the casing of the electrostatic atomization device. Thus, there is a tendency for heat to remain in the entire electrostatic atomization device. Such heat may affect the electric circuit performance and cooling performance of the electric circuit.

It is an object of the present invention to provide an electrostatic atomization device that improves the heat radiation efficiency.

One aspect of the present invention is an electrostatic atomization device for electrostatically atomizing condensed water and emitting atomized water. The electrostatic atomization device includes a discharge electrode to which high voltage is applied. A water supplier unit includes a cooling unit coupled to the discharge electrode to cool the discharge electrode and a heat radiation unit coupled to the cooling unit to emit heat when the cooling unit performs cooling. The cooling unit cools air and produces condensed water that is supplied to the discharge electrode from moisture in the air. A controller includes a plurality of electronic components mounted on a circuit board. The controller supplies power and controls at least either one of the discharge electrode and the water supplier unit. A casing accommodates the discharge electrode, the water supplier unit, and the controller. The circuit board of the controller includes a heat radiation unit side region having a heat radiation unit side edge facing toward the heat radiation unit. The plurality of electronic components include first electronic components each of which temperature is increased by a predetermined value or greater when operated arranged in the heat radiation unit side region of the circuit board.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
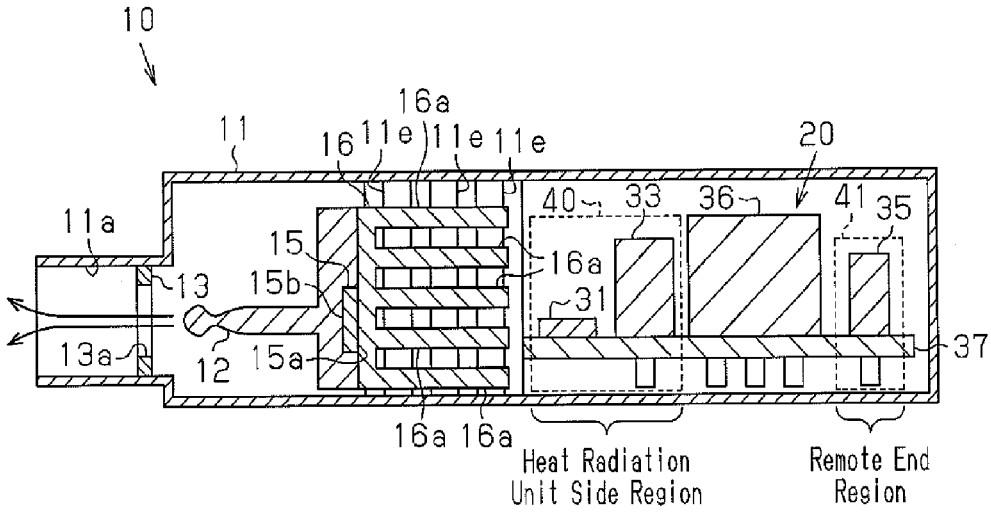
FIG. 1 is a cross-sectional view of an electrostatic atomization device according to a first embodiment.
Figure 2:
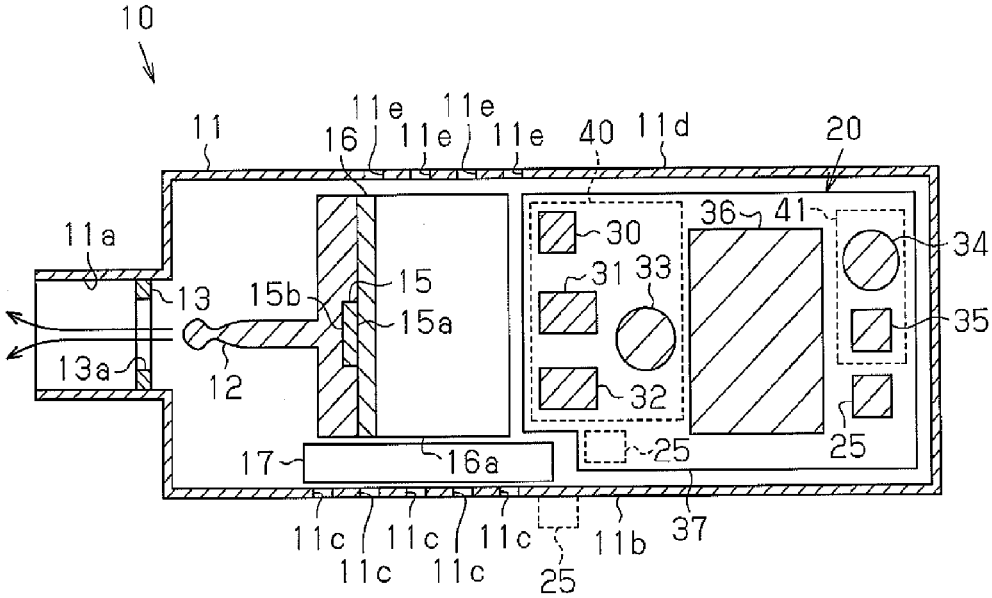
FIG. 2 is a cross-sectional view of the electrostatic atomization device of FIG. 1.

An electrostatic atomization device according to a first embodiment of the present invention will now be discussed with reference to FIGS. 1 and 2.

An electrostatic atomization device 10 includes a casing 11, which accommodates a discharge electrode 12. The casing 11 may be formed from a metal material, a resin material, or a compound of these materials. The metal casing is preferable when protecting circuits 21 to 26, which will be described later, from noise and the like that may occur. The resin casing is preferable for obtaining an electrical insulation property.

The casing 11 includes an open distal end 11*a*. The discharge electrode 12 extends toward the open distal end 11*a* in the casing 11, and the discharge electrode 12 has a distal end facing towards the open distal end 11*a* of the casing 11. An annular opposing electrode 13 is arranged in open distal end 11*a* of the casing 11 facing toward the discharge electrode 12. The opposing electrode 13 has a hole 13*a*, the center of which lies along the axis of the discharge electrode 12.

The discharge electrode 12 has a basal end, which is in contact with a Peltier element 15 serving as a cooling unit that cools the discharge electrode 12 and produces condensed water on the surface of the discharge electrode 12 from the moisture in the air around the discharge electrode 12. The Peltier element 15 includes a plurality of thermoelectric elements (not shown) held between two metal plates (not shown) and exhibits a cooling effect when supplied with power. The Peltier element 15 has a rear surface 15*a*, which is in contact with a basal end of a heat radiation fin 16 serving as a heat radiation unit. The heat radiation fin 16 includes a plurality of (e.g., five) plate-shaped fin portions 16*a*, which are arranged in predetermined intervals. Each fin portion 16*a* extends away from the Peltier element 15. When the thermoelectric elements of the Peltier element 15 are supplied with power, the Peltier element 15 absorbs heat from the discharge electrode 12, and the heat is radiated from the heat radiation fin 16 (fin portions 16*a*). This heat transfer cools the discharge electrode 12 and thereby produces condensed water on the discharge electrode 12. In this manner, water is supplied to the discharge electrode 12. The Peltier element 15 and the heat radiation fin 16 serve as a water supplier unit.

A ventilation fan 17 serving as a blower unit for blowing air in the planar direction of the fin portions 16*a* of the heat radiation fin 16 is arranged beside the heat radiation fin 16. When operated, the ventilation fan 17 draws air (ambient air) into the casing 11 through air inlets 11*c* formed in a side surface 11*b* of the casing 11 at a substantially intermediate position in the longitudinal direction. Further, the ventilation fan 17 emits air (heat) out of the casing 11 through air outlets 11*e*, which are formed in a side surface 11*d* opposite to the side surface 11*b*. This efficiently radiates heat from the heat radiation fin 16, improves the cooling effect of the Peltier element 15, and lowers the environmental temperature in the casing 11.

Figure 3:
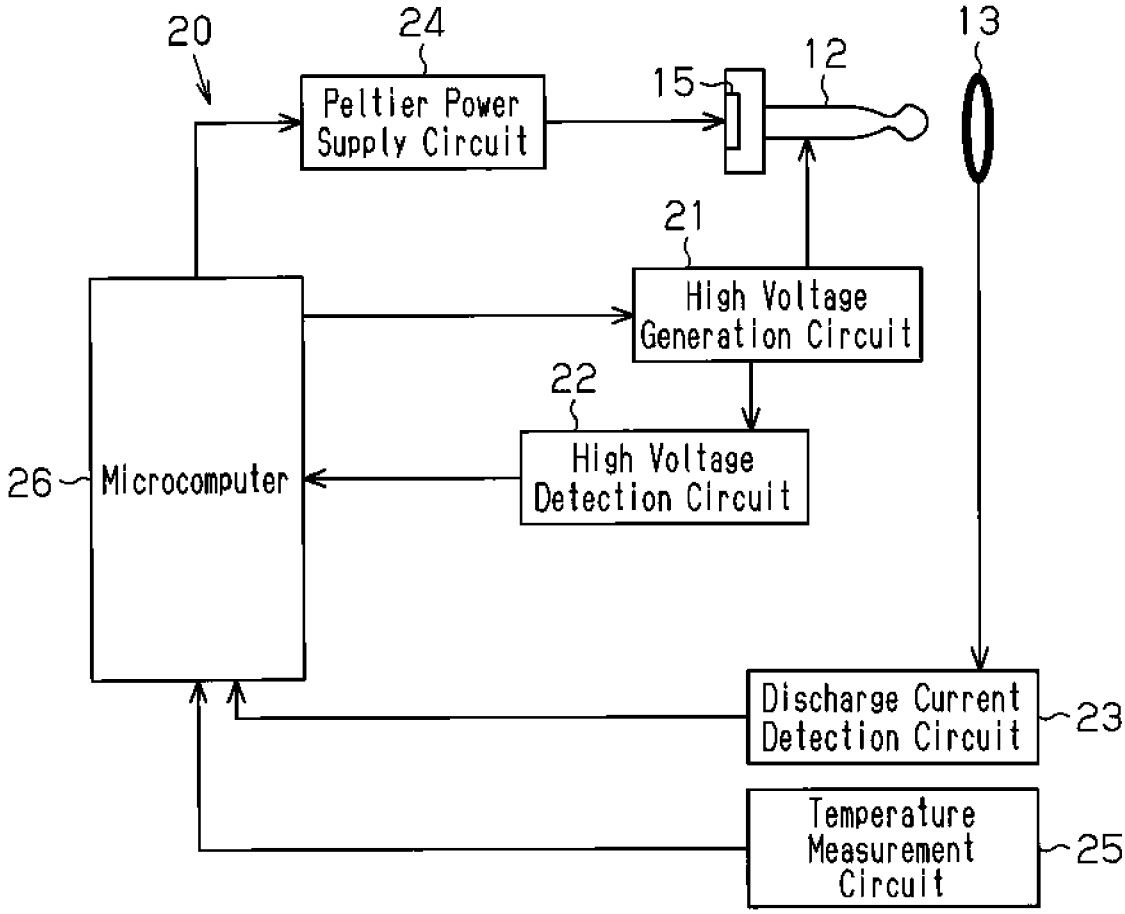
FIG. 3 is a block diagram of the electrostatic atomization device of FIG. 1.

A controller 20 is arranged in the casing 11 at the distal end side of the heat radiation fin 16. As shown in FIG. 3, the controller 20 includes a high voltage generation circuit 21, a high voltage detection circuit 22, a discharge current detection circuit 23, a Peltier power supply circuit 24, a temperature measurement circuit 25, and a microcomputer 26. The high voltage generation circuit 21 generates and supplies high voltage to the discharge electrode 12 so that a corona discharge occurs at the discharge electrode 12. The high voltage detection circuit 22 detects the generated high voltage, and the discharge current detection circuit 23 detects discharge current. The microcomputer 26 controls the high voltage generation circuit 21 in accordance with the detection results of the high voltage detection circuit 22 and the discharge current detection circuit 23. The temperature measurement circuit 25 detects the environmental temperature in the casing 11. The microcomputer 26 controls the Peltier power supply circuit 24 in accordance with the measurement result of the temperature measurement circuit 25. The Peltier power supply circuit 24 supplies the Peltier element 15 with operational power in accordance with the control of the microcomputer 26. The Peltier element 15 performs a cooling operation when supplied with the operational power.

The circuits 21 to 23 of the controller 20 are formed by electronic components 30 to 36, which are mounted on a circuit board 37. The electronic components 30 to 36 of the circuits 21 to 23 are roughly divided into a first electronic component group 40 and a second electronic component group 41 in accordance with the level of heat loss or heat generation.

The first electronic component group 40 is a collection of electronic components increased in temperature by a predetermined value or greater from the ambient temperature (temperature outside the casing 11) during use of the electrostatic atomization device 10, that is, electronic components each having a large heat loss (large heat generation). In a non-limited example, the predetermined value for temperature increase is 20° C. Specific examples of the components in the first electronic component group 40 include a switching element, such as a diode and an FET, a regulator, and an inductor. In the illustrated example, the first electronic component group 40 is exclusively arranged in a heat radiation unit side region of the circuit board 37.

The second electronic component group 41 is a collection of electronic components of which the temperature increase is less than that of the first electronic component group 40, that is, electronic components each having a small heat loss (small heat generation). Specific examples of the components in the second electronic component group 41 include an electrolytic capacitor and a fuse.

The electronic components 30 to 33 of the first electronic component group 40 are gathered or concentrated in proximity to the heat radiation fin 16. In the illustrated example, the circuit board 37 includes an edge (also referred to as heat radiation unit side edge) facing toward the distal end of the heat radiation fin 16, and the electronic components 30 to 33 are gathered in an end region (also referred to as heat radiation unit side region) located at the side of the circuit board 37 closer to the heat radiation fin 16. By arranging the first electronic component group 40 in proximity to the heat radiation fin 16, the heat radiation fin 16 may be used not only for emission of the heat generated by the cooling unit 15 but also for emission of the heat generated by the first electronic component group 40. The arrangement of the circuit board 37 near the heat radiation fin 16 and the arrangement of the electronic components on the circuit board 37 allows for the first electronic component group 40 to be used without an exclusive heat radiation fin. Such an arrangement allows for the electrostatic atomization device 10 to be reduced in size as compared to when a heat radiation fin is provided for the circuits that generate a large amount of heat.

In the illustrated example, the electronic components 30 to 33 of the first electronic component group 40 are arranged in proximity to the heat radiation fin 16 and are exposed to a cooling air flow produced by the ventilation fan 17. The electronic components 34 and 35 of the second electronic component group 41 are spaced apart from the heat radiation fin 16 on the circuit board 37. Further, the electronic components 34 and 35 of the second electronic component group 41 are preferably arranged in a remote end region (right side as viewed in the examples of FIGS. 1 and 2) opposite to the heat radiation unit side region of the circuit board 37.

A third electronic component 36 is arranged between the first and second electronic component groups 40 and 41. The third electronic component 36 is taller and wider than the electronic components 30 to 35 of the first and second electronic component groups 40 and 41. In the illustrated example, the third electronic component 36 is a high voltage application module. The third electronic component 36 functions as a heat blocking fence that prevents the air warmed by the first electronic component group 40, which generates a large amount of heat, from being circulated towards the second electronic component group 41.

In the electrostatic atomization device 10, a front surface 15*b* of the Peltier element 15 absorbs heat when the microcomputer 26 controls the Peltier power supply circuit 24 and supplies power to the Peltier element 15. This cools the discharge electrode 12, which is in contact with the front surface 15*b* of the Peltier element 15. The moisture in the air condenses on the surface of the cooled discharge electrode 12 and supplies water (condensed water) to the discharge electrode 12.

When the high voltage generation circuit 21 applies high voltage between the discharge electrode 12 and the opposing electrode 13 in a state in which water is supplied to the discharge electrode 12, the supplied water is repetitively fragmented and scattered (Rayleigh fission) by the high voltage applied between the discharge electrode 12 and the opposing electrode 13. This generates a large amount of positively or negatively charged mist of a microscopic size. The generated mist is emitted out of the casing 11 from the open distal end 11*a*.

In the electrostatic atomization device 10 described above, the ventilation fan 17 is preferably driven to generate a cooling air flow when the Peltier element 15 is supplied with power. The air (ambient air) is drawn into the casing 11 through the air inlets 11*c* when the ventilation fan 17 is driven. The drawn in air flows towards the air outlets 11*e* as a cooling air flow and releases the heat of the heat radiation fin 16 and the first electronic component group 40, which are arranged in the path of the cooling air flow, out of the air outlets 11*e*. In this case, the third electronic component 36 (large high voltage application module) blocks the flow of air from the first electronic component group 40 to the second electronic component group 41. This prevents the air heated by the heat radiation fin 16 and the first electronic component group 40 from reaching the second electronic component 41. Thus, the second electronic component group 41 is less affected by the heat generated by the heat radiation fin 16 and the first electronic component group 40. Further, the second electronic component group 41 may exhibit the desired circuit characteristics.

The temperature measurement circuit 25 is arranged in the electrostatic atomization device 10 (in the casing 11) near the second electronic component group 41. Thus, the measurement result, that is, the usage environment temperature of the temperature measurement circuit 25 is less likely to be affected by the heat of the electronic components 30 to 33 in the first electronic component group 40. In other words, the temperature measurement circuit 25 measures the temperature (usage environmental temperature) that is closer to the ambient temperature than when arranged near the first electronic component group 40. Since the microcomputer 26 drives (cools) the Peltier element 15 in accordance with the measurement result of the temperature measurement circuit 25, condensation occurs in an optimal manner on the discharge electrode 12 in accordance with the usage environmental temperature.

The first embodiment has the advantages described below.

(1) The circuit board 37 of the controller 20 includes the heat radiation unit side edge facing toward the heat radiation fin 16 of the water supplier unit, and the electronic components 30 to 33 (first electronic component group 40), which generate a large mount of heat and which are increased in temperature by a predetermined value or greater during operation, are gathered in the heat radiation unit side region including the heat radiation unit side edge. By gathering the heat radiation fin 16 and the first electronic component group 40 in the electrostatic atomization device 10, the heat radiation fin 16 may be used not only for the emission of heat generated by the cooling unit 15 but also for the emission of heat generated by the first electronic component group 40. This structure reduces the number of heat radiation units in the electrostatic atomization device 10, allows for the electrostatic atomization device 10 to be reduced in size, and improves the heat emission efficiency.

(2) The first electronic component group 40 is arranged in proximity to the heat radiation fin 16 of the water supplier unit, and the ventilation fan 17 serving as a blower unit sends a cooling air flow to the heat radiation fin 16 and the first electronic component group 40. That is, the close arrangement (gathering) of the first electronic component group 40 (electronic components 30 to 33), which are members that easily generate heat, and the heat radiation fin 16 allows for the first electronic component group 40 and the heat radiation fin 16 to be cooled with the single ventilation fan 17. The ventilation fan 17 is used not only to emit the heat generated by the cooling unit 15 but also to emit the heat generated by the first electronic component group 40. This efficiently lowers the temperature of the electrostatic atomization device 10 (casing 11) and reduces the heat generated in other areas of the electrostatic atomization device 10 (casing 11). The close arrangement of the circuit board 37, the heat radiation fin 16, and the ventilation fan 17, and the arrangement of the electronic components on the circuit board 37 reduce the number of ventilation fans in the electrostatic atomization device 10 and allows for the electrostatic atomization device 10 to be reduced in size.

(3) Among the electronic components 30 to 36 of the controller 20, the electronic components 34 and 35 (second electronic component group 41) that generate less heat than the electronic components 30 to 33 form the first electronic component group 40. The third electronic component 36, which is larger in size than the first and second electronic component groups 40 and 41, is arranged in an intermediate region between the first and second electronic component groups 40 and 41. This prevents environmental exchange between the first and second electronic component groups 40 and 41. That is, among the electronic components 30 to 36 of the controller 20, the third electronic component 36 that has a large size is arranged between the first and second electronic component groups 40 and 41. Thus, the heat generated by the electronic components 30 to 33 in the first electronic component group 40 is prevented from being transferred to the second electronic component group 41. This allows for the desired circuit characteristics to be obtained in the second electronic component group 41.

(4) The controller 20 controls the cooling operation of the Peltier element 15, which forms the water supplier unit, based on the usage environmental temperature detected by the temperature measurement circuit 25, which serves as the temperature sensor. The temperature measurement circuit 25 is arranged near the electronic components 34 and 35 of the second electronic component group 41, which generate less heat than the electronic components 30 to 33 of the first electronic component group 40. The temperature measurement circuit 25 is thus less likely to be affected by the heat from the first electronic component group 40. This ensures that the temperature measurement circuit 25 measures the usage environment temperature. Thus, condensation occurs in an optimal manner on the discharge electrode 12 in accordance with the usage environment temperature.

An electrostatic atomization device 10 according to a second embodiment will now be discussed focusing on differences from the first embodiment. The second embodiment is similar to the first embodiment except in that the heat radiation fin 16 is in contact with the first electronic component group 40 of the controller 20.

Figure 5:
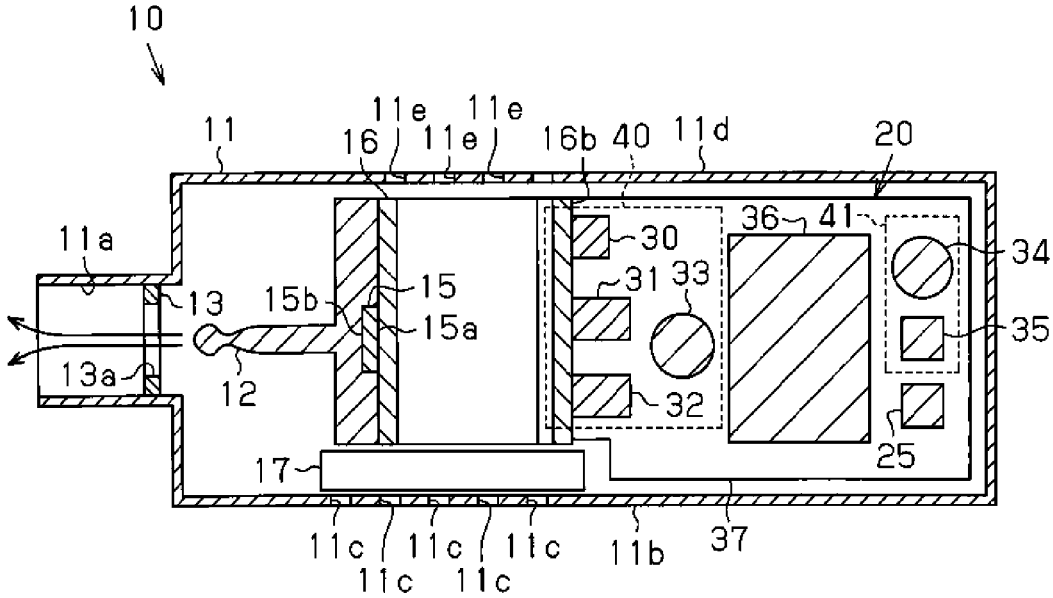
FIG. 5 is a cross-sectional view of the electrostatic atomization device of FIG. 4.

In the same manner as the first embodiment, the heat radiation fin 16 serving as the heat radiation unit contacts the rear surface 15*a* of the Peltier element 15. The heat radiation fin 16 of the second embodiment includes a plurality of (e.g., five) plate-shaped fin portions 16*a* arranged in predetermined intervals and extending away from the Peltier element 15, and an extended portion 16*b*, which extends from one of the fin portions 16*a*. As shown in FIG. 5, the extended portion 16*b* is in contact with the first electronic component group 40 (electronic components 30 to 32). The extended portion 16*b* of the heat radiation fin 16 may be formed by bending one of the fin portions 16*a*.

When power is supplied to the thermoelectric elements of the Peltier element 15, the Peltier element 15 absorbs heat from the discharge electrode 12 and the like, and the heat radiation fin 16 (fin portion 16*a* and extended portion 16*b*) radiates the heat. This cools the discharge electrode 12 so that condensation occurs and produces (supplies) condensed water on the discharge electrode 12.

In the same manner as the first embodiment, the circuits 21 to 23 of the controller 20 are formed by the electronic components 30 to 36 mounted on the circuit board 37.

Figure 4:
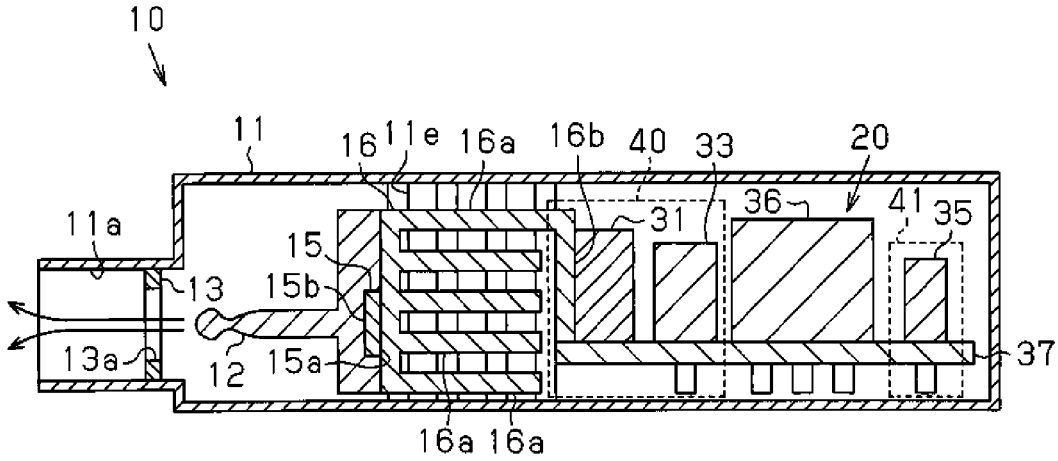
FIG. 4 is a cross-sectional view of an electrostatic atomization device according to a second embodiment.

The electronic components 30 to 33 of the first electronic component group 40 are arranged in proximity to the heat radiation fin 16 on the circuit board 37, and the electronic components 30 to 32 are in contact with the extended portion 16*b*. Thus, heat from the electronic components 30 to 32, which generate a large amount of heat, is transferred to the extended portion 16*b* (heat radiation fin 16). The electronic components 30 to 33 of the first electronic component group 40 are exposed to a cooling air flow produced by the ventilation fan 17. The electronic components 34 and 35 of the second electronic component group 41 are spaced apart from the heat radiation fin 16 on the circuit board 37. Further, the electronic components 34 and 35 of the second electronic component group 41 are preferably arranged in a remote end region (right side as viewed in the examples of FIGS. 4 and 5) opposite to the heat radiation unit side region of the circuit board 37.

In the electrostatic atomization device 10, the ventilation fan 17 is preferably driven to generate the cooling air flow when the Peltier element 15 is supplied with power. When the ventilation fan 17 is driven, air (ambient air) is drawn into the casing 11 through the air inlets 11*c*. The drawn in air flows toward the air outlets 11*e* as a cooling air flow and releases the heat of the heat radiation fin 16 and the first electronic component group 40, which are arranged in the path of the cooling air flow, out of the air outlets 11*e*. Since the heat radiation fin 16 and the first electronic component group 40 are both cooled, heat is efficiently radiated from the electrostatic atomization device 10 (casing 11).

Due to the contact of the extended portion 16*b* with the electronic components 30 to 32, the heat of the electronic components 30 to 32, which generate a large amount of heat, is efficiently transferred towards the heat radiation fin 16. The extended portion 16*b* increases the heat radiation efficiency of the electronic components 30 to 32. Thus, each of the members 15, 30, 31, and 32 do not have to be provided with an exclusive heat radiation fin and an exclusive ventilation fan. In this manner, contact of the extended portion 16*b* and the electronic components 30 to 32 allows for an increase in the efficiency of heat emission and reduction in the size of the electrostatic atomization device 10.

The second embodiment has the advantages described below.

(5) Among the electronic components 30 to 36 of the controller 20, all or some of the electronic components 30 to 33 (first electronic component group 40) that generate a large amount of heat are in contact with the heat radiation fin 16, which serves as the heat radiation unit of the water supplier unit. This further improves advantages (1) to (4) of the first embodiment.

(6) The first electronic component group 40 is arranged on the circuit board 37 in the heat radiation unit side region, which is closer to the Peltier element 15 and the heat radiation fin 16 that form the water supplier unit. This allows the entire heat radiation fin 16 to have a shorter length and thereby allows for the entire electrostatic atomization device 10 to be reduced in size.

An electrostatic atomization device 10 according to a third embodiment will now be discussed with reference to FIGS. 7 to 9 focusing on differences from the second embodiment. The third embodiment is similar to the second embodiment except in that the heat radiation fin 16 is coupled to the casing 11 in a heat transferrable manner.

In the same manner as the second embodiment, the heat radiation fin 16 of the third embodiment includes a plurality of (e.g., five) plate-shaped fin portions 16*a*, which are arranged in predetermined intervals and extend away from the Peltier element 15, and an extended portion 16*b*, which extends from one of the fin portion 16*a*. As shown in FIG. 8, the extended portion 16*b* is in contact with the first electronic component group 40 (electronic components 30 to 32). The extended portion 16*b* of the heat radiation fin 16 may be formed by bending one of the fin portions 16*a*.

Figure 7:
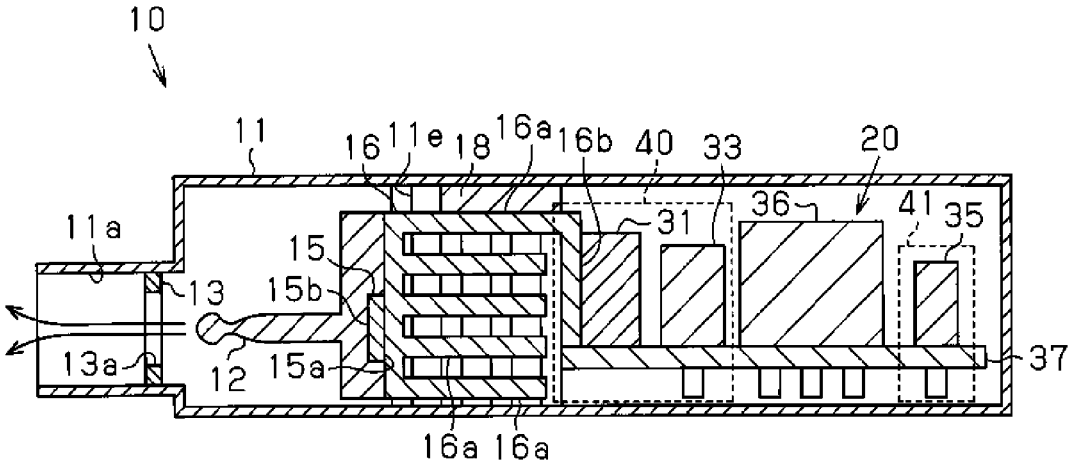
FIG. 7 is a cross-sectional view of an electrostatic atomization device according to a third embodiment.
Figure 8:
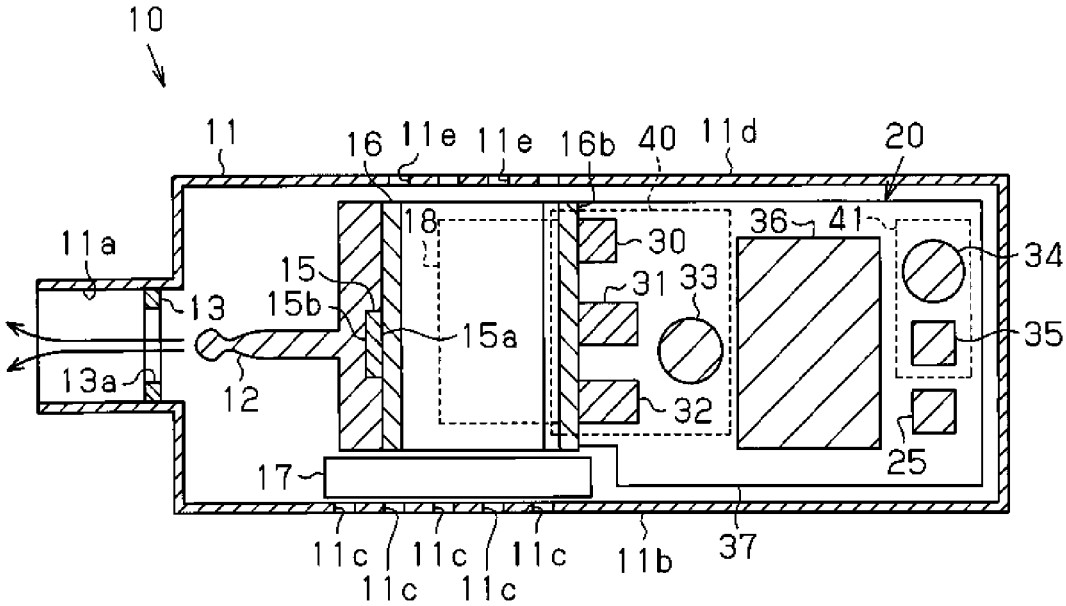
FIG. 8 is a cross-sectional view of the electrostatic atomization device of FIG. 7.
Figure 9:
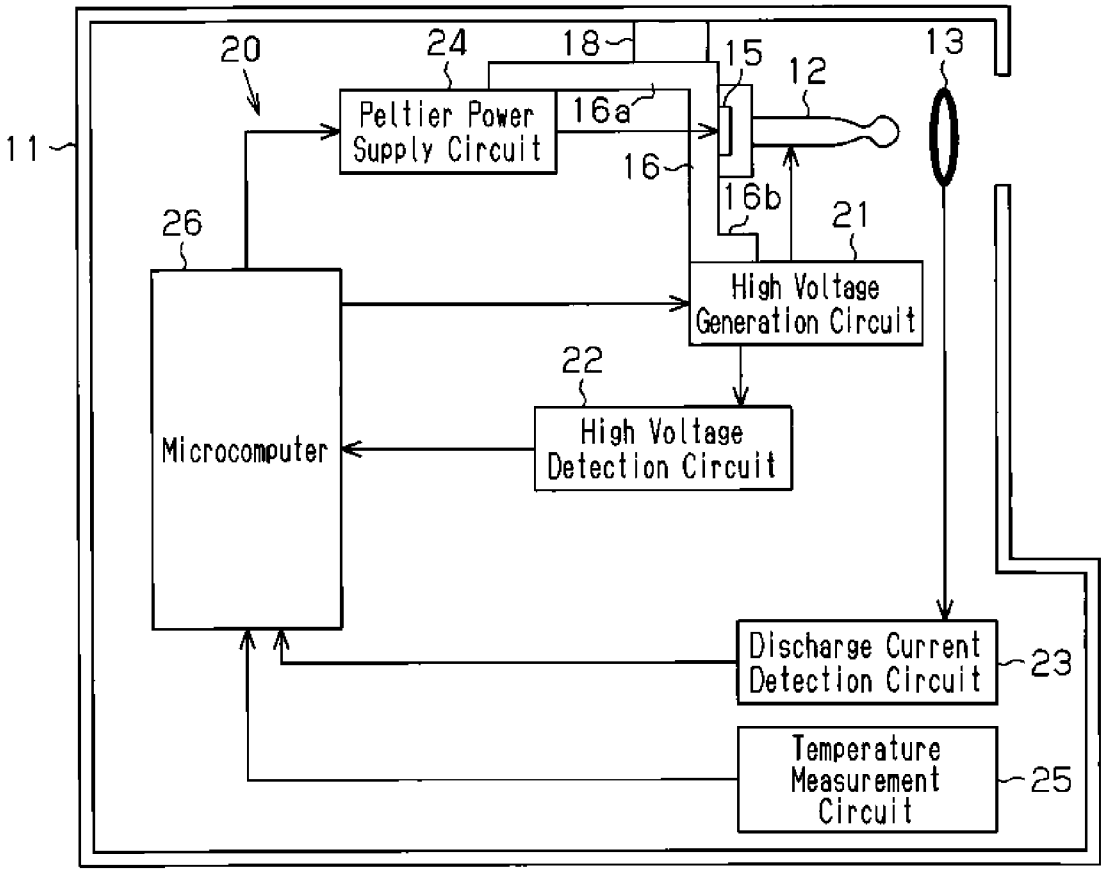
FIG. 9 is a block diagram of the electrostatic atomization device of FIG. 7.

As shown in FIGS. 7 and 9, the fin portion 16*a* including the extended portion 16*b* is coupled to the casing 11 by a heat conduction paste 18. The heat conduction paste 18 is a heat transferrable material and absorbs mechanical stress produced when vibration occurs and when temperature changes cause material expansion or contraction. The heat conduction paste 18 transmits heat to the casing 11 from the members that are in contact with the heat radiation fin 16. FIG. 9 shows only the fin portion 16*a* that includes the extended portion 16*b*. The fin portions 16*a* that do not include the extended portion 16*b* are not shown.

When power is supplied to the thermoelectric elements of the Peltier element 15, the Peltier element 15 absorbs heat from the discharge electrode 12 and the like. The heat is radiated from the heat radiation fin 16 and the casing 11, which transfers heat from the heat radiation fin 16 via the heat conduction paste 18. Accordingly, the casing 11 is used in a positive manner to radiate heat. The Peltier element 15 cools the discharge electrode 12 so that condensation occurs and produces (supplies) condensed water on the discharge electrode 12.

In the electrostatic atomization device 10, the ventilation fan 17 is preferably driven to generate a cooling air flow when the Peltier element 15 is supplied with power. Air (ambient air) is drawn into the casing 11 through the air inlets 11*c* when the ventilation fan 17 is driven. The drawn in air flows towards the air outlets 11*e* as a cooling air flow and releases the heat of the heat radiation fin 16 and the first electronic component group 40, which are arranged in the path of the cooling air flow, out of the air outlets 11*e*.

Contact of the extended portion 16*b* with the electronic components 30 to 32, which generate a large amount of heat, radiates heat from the electronic components 30 to 32 in an optimal manner. Thus, the heat of the electronic components 30 to 32, which generate a large amount of heat, is efficiently transferred to the heat radiation fin 16. Thus, each of the members 15, 30, 31, and 32 do not need a heat radiation fin, and the entire electrostatic atomization device 10 may be reduced in size.

The fin portions 16*a* of the heat radiation fin 16 are coupled to the casing 11, which is heat radiative, by the heat conduction paste 18 in a heat transferrable manner. This radiates the heat of the fin portions 16*a* from the casing 11 with the heat conduction paste 18. Thus, heat radiation and cooling are performed with further efficiency. Further, due to the heat conduction paste 18 that absorbs vibration and mechanical stress, stress is prevented from being transferred to the circuit board 37 and the like. This prevents damage to the circuit board 37, such as so-called solder cracks and pattern disconnections in the printed circuit.

The third embodiment has the advantages described below.

(7) The casing 11 is heat radiative, and the controller 20 includes the electronic components 30 to 36 mounted on the circuit board 37. Among the electronic components 30 to 36, the electronic components 30 to 32, which generate a large amount of heat and increase the temperature by a predetermined value (e.g., 20 degrees) or greater during operation, and the heat radiation fin 16 of the water supplier unit are coupled to the casing 11 in a heat transferrable manner. The heat of the electronic components 30 to 32, which generate a large amount of heat, and the heat of the heat radiation fin 16 of the water supplier unit are both transferred to the casing 11, which is a heat radiative, and then radiated from the casing 11. The casing 11 is used in a positive manner for heat radiation. Thus, each of the members 16 and 30 to 32 do not require a heat radiation unit (heat radiation fin). Thus, the heat radiation effect is improved, while allowing for the electrostatic atomization device 10 to be reduced in size. This further improves, advantages (1) to (4) of the first embodiment and advantages (5) and (6) of the second embodiment.

(8) The electronic components 30 to 32, which generate a large amount of heat, and the heat radiation fin 16 of the water supplier unit are both coupled to the casing 11 by the heat conduction paste 18. Thus, the heat conduction paste 18 absorbs vibration and mechanical stress and prevents damage to the circuit board 37 and the like.

It should be apparent to those skilled in the art that the present invention may be embodied in many other specific forms without departing from the spirit or scope of the invention. Particularly, it should be understood that the present invention may be embodied in the following forms.

In the first to third embodiments, the temperature measurement circuit 25 is arranged near the second electronic component group 41, which heat loss is less than the first electronic component group 40. However, the present invention is not limited in such a manner. For example, the temperature measurement circuit 25 may be arranged outside the casing 11 or near the air inlets 11*c*.

The temperature measurement circuit 25 may be eliminated in the first to third embodiments.

In the first to third embodiments, the third electronic component 36, which is formed by a large high voltage application module, is arranged between the first electronic component group 40 and the second electronic component group 41. However, the present invention is not limited in such a manner. For example, the third electronic component 36 may be eliminated. It is only required that the first electronic component group 40 and the second electronic component group 41 sufficiently spaced apart.

In the first to third embodiments, the electronic components 30 to 36 of the high voltage generation circuit 21, the high voltage detection circuit 22, and the discharge current detection circuit 23 form the first electronic component group 40, the second electronic component group 41, and the third electronic component 36. However, electronic components in other circuits of the controller 20, such as the Peltier power supply circuit 24, may be divided into the first electronic component group 40, the second electronic component group 41, and the like.

Figure 6:
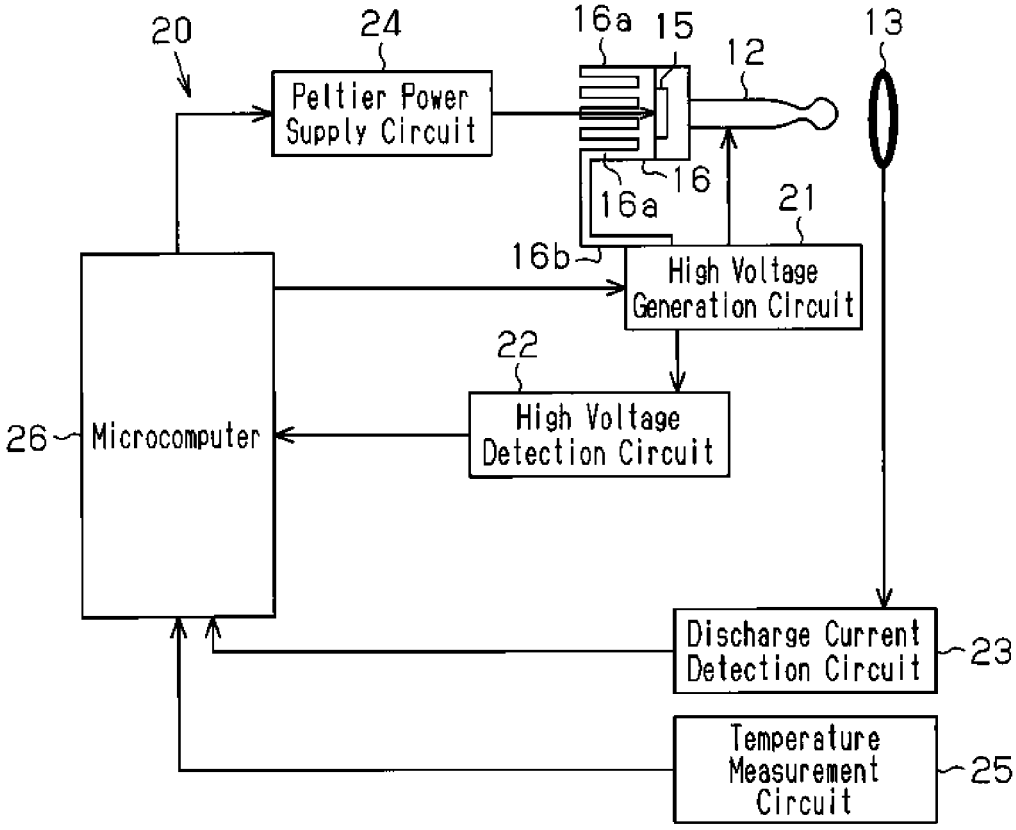
FIG. 6 is a block diagram of the electrostatic atomization device of FIG. 4.

In the second embodiment, the heat radiation fin 16 is in contact with the electronic components 30 to 32 of the first electronic component group 40. However, the present invention is not limited in such a manner. For example, the heat radiation fin 16 may contact the electronic component 33 of the first electronic component group 40. It is only required that among the electronic components 30 to 36, at least the electronic components 30 to 33 each of which temperature is increased by a predetermined value or greater, be in contact with contact the heat radiation fin 16. This would allow the heat radiation fin 16 to be shared by the first electronic component group 40 and the Peltier element 15 of the water supplier unit. In the example shown in FIG. 6, the extended portion 16*b* of the heat radiation fin 16 is in contact with the high voltage generation circuit 21. The heat radiation fin 16 may be formed to contact an electronic component in other circuits such as the Peltier power supply circuit 24 (see FIG. 9) of which temperature may be increased by a predetermined value during use of the electronic component.

In the second embodiment, the single extended portion 16*b* of the heat radiation fin 16 is in contact with the electronic components 30 to 32 of the first electronic component group 40. However, the present invention is not limited in such a manner. For example, a plurality of fin portions 16*a* of the heat radiation fin 16 may contact the electronic components 30 to 32.

In the first to third embodiments, the heat radiation fin 16 includes a total of five fin portions 16*a*. However, the heat radiation fin 16 may have any number of fin portions 16*a*.

In the third embodiment, the heat radiation fin 16 coupled to the Peltier element 15 of the water supplier unit does not have to be in contact with the electronic components 30 to 32, which generate a large amount of heat (first electronic component group 40). In this case, the electronic components 30 to 32, which generate a large amount of heat, may be in direct contact with the casing 11, which is heat radiative. Alternatively, heat conduction paste may be applied between the electronic components 30 to 32, which generate a large amount of heat, and the casing 11. Further, the electronic component 33, which generates a large amount of heat, may be in contact with the heat radiation fin 16.

In the third embodiment, the heat radiation fin 16 is arranged at the basal end side of the Peltier element 15, which forms the water supplier unit. However, the present invention is not limited in such a manner. For example, the heat radiation fin 16 may be eliminated. In this case, the Peltier element 15 may be in direct contact with the casing 11, which is heat radiative. Alternatively, a heat conduction paste may be applied between the Peltier element 15 and the casing 11.

In the third embodiment, the heat conduction paste 18 may be replaced by a heat conduction sheet. Alternatively, the heat conduction paste 18 may be eliminated, and the heat radiation fin 16 may be in direct contact with the casing 11.

In the third embodiment, the ventilation fan 17 may be eliminated. In such a structure, fewer components are required. This allows for the electrostatic atomization device 10 to be further reduced in size.

The structures of the first to third embodiments may be combined when required. For instance, the heat conduction paste 18 of the third embodiment may be used in the first embodiment.

The present examples and embodiments are to be considered as illustrative and not restrictive, and the invention is not to be limited to the details given herein, but may be modified within the scope and equivalence of the appended claims.

What is claimed is:

1. An electrostatic atomization device for electrostatically atomizing condensed water and emitting atomized water, the electrostatic atomization device comprising:

a discharge electrode to which high voltage is applied;

a water supplier unit including a cooling unit coupled to the discharge electrode to cool the discharge electrode and a heat radiation unit coupled to the cooling unit to emit heat when the cooling unit performs cooling, the cooling unit cooling air and producing condensed water that is supplied to the discharge electrode from moisture in the air;

a controller including a plurality of electronic components mounted on a circuit board, the controller supplying power and controlling at least either one of the discharge electrode and the water supplier unit; and a casing that accommodates the discharge electrode, the water supplier unit, and the controller;

wherein the circuit board of the controller includes a heat radiation unit side region having a heat radiation unit side edge facing toward the heat radiation unit; and the plurality of electronic components include first electronic components each of which temperature is increased by a predetermined value or greater when operated arranged in the heat radiation unit side region of the circuit board.

2. The electrostatic atomization device according to claim 1, further comprising:

a blower unit that is accommodated in the casing and generates a cooling air flow for cooling the heat radiation unit of the water supplier unit;

wherein at least part of the first electronic components is exposed to the cooling air flow generated by the blower unit.

3. The electrostatic atomization device according to claim 2, wherein the plurality of electronic components include second electronic components, each of which generates less heat than each of the first electronic components and is arranged in a remote end region that excludes the heat radiation unit side region, and a third electronic component, which is larger in size than the first and second electronic components; and the third electronic component is arranged in a region between the first electronic components and the second electronic components to prevent gas from being circulated from the first electronic components towards the second electronic components.

4. The electrostatic atomization device according to claim 2, wherein the controller controls the water supplier unit to perform cooling in accordance with a usage environmental temperature measured by a temperature sensor; and the temperature sensor is arranged near an air inlet of the casing, near a second electronic component that generates less heat than each of the first electronic components, or outside the casing.

5. The electrostatic atomization device according to claim 3, wherein the first electronic components, the third electronic component, and the second electronic components are arranged on the circuit board in order from the one closest to the heat radiation unit.

6. The electrostatic atomization device according to claim 5, wherein the casing includes an air inlet and an air outlet; and the heat radiation unit is arranged on a cooling flow path, which connects the air inlet and the air outlet, and faces toward at least one of the first electronic components.

7. The electrostatic atomization device according to claim 5, wherein the second electronic components are arranged on the circuit board in the remote end region opposite to the heat radiation unit side region, and the third electronic component is arranged in an intermediate region between the heat radiation unit side region and the remote end region.

8. The electrostatic atomization device according to claim 1, wherein the first electronic components are exclusively arranged in the heat radiation unit side region of the circuit board.

9. The electrostatic atomization device according to claim 1, wherein the heat radiation unit is shared for heat radiation from the water supplier unit and heat radiation from the first electronic components.

10. The electrostatic atomization device according to claim 9, wherein at least one of the first electronic components contacts the heat radiation unit of the water supplier unit.

11. The electrostatic atomization device according to claim 10, further comprising:

a blower unit that is arranged in the casing and cools the heat radiation unit of the water supplier unit.

12. The electrostatic atomization device according to claim 1, wherein the casing is heat radiative; and at least either one of the first electronic components and the heat radiation unit of the water supplier unit is coupled to the casing in a heat transferrable manner.

13. The electrostatic atomization device according to claim 12, further comprising:

a heat conduction paste that couples at least either one of the first electronic components and the heat radiation unit of the water supplier unit to the casing.

* * * * *